US006703940B1

(12) United States Patent
Allen et al.

(10) Patent No.: US 6,703,940 B1
(45) Date of Patent: Mar. 9, 2004

(54) TRANSCEIVING REMOTE CONTROLLING

(75) Inventors: William A. Allen, Westborough, MA (US); Herbert C. Knapp, Holliston, MA (US); Kenneth S. Lyons, Middleborough, MA (US); James B. McElroy, Jr., Hollis, NH (US); Alan Schell, Hopkinton, MA (US); Lauren L'Esperance, Arlington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/333,410

(22) Filed: Jun. 15, 1999

(51) Int. Cl.[7] ..... G08C 19/00

(52) U.S. Cl. ..... 340/825.69; 340/825.24; 340/825.25

(58) Field of Search ..... 340/825.24, 825.25, 340/825.69; 369/7; 370/465; 345/626, 173, 178, 172

(56) References Cited

U.S. PATENT DOCUMENTS

| | | | | | |
|---|---|---|---|---|---|
| 5,835,093 | A | * | 11/1998 | Fujishita et al. | 345/353 |
| 5,900,867 | A | * | 5/1999 | Schindler | 345/327 |
| 5,946,343 | A | * | 8/1999 | Schotz et al. | 375/200 |
| 5,963,624 | A | * | 10/1999 | Pope | 379/110.01 |
| 2002/0057207 | A1 | * | 5/2002 | Sgambati et al. | 340/825.25 |

* cited by examiner

*Primary Examiner*—Michael Horabik
*Assistant Examiner*—Vernal U Brown
(74) *Attorney, Agent, or Firm*—Fish & Richardson P.C.

(57) ABSTRACT

An audio system may include a plurality of sound reproduction devices characterized by parameter values; a plurality of audio signal sources characterized by parameter values; a plurality of remote control devices, a system controller, constructed and arranged to wirelessly receive command signals from the remote control devices and to wirelessly transmit parameter values of audio signal sources and of sound reproduction sources to the remote control device. The remote control devices are constructed and arranged for wirelessly transmitting command signals to the system controller and for wirelessly receiving parameter values and displaying parameter values. The remote control devices are being further constructed and arranged to transmit command signals to and receive parameter values from a system controller that is separated from remote control. A remote control for use with the audio system illuminates only graphic figures corresponding to terminals to which a sound reproduction device is attached; illuminates graphic figures corresponding to surround speakers only if a selected sound reproduction device is equipped for surround speakers; and has a touch screen which can be disabled. An audio system has volume adjusting circuitry which allows collective volume adjusting of different devices while maintaining a volume offset, and has circuitry which allows collective turning on and off of sound reproduction devices receiving signals from the same signal source.

3 Claims, 8 Drawing Sheets

TRANSCEIVING REMOTE CONTROLLING

The invention relates to audio systems having remote controllers, and more particularly audio systems having transceiving remote control with variable displays.

It is an important object of the invention to provide an improved remotely controllable audio system and to further provide improved remote controlling.

According to an aspect of the invention, an audio system includes a plurality of sound reproduction devices characterized by parameter values; a plurality of audio signal sources characterized by parameter values; a plurality of remote control devices; and a system controller, constructed and arranged to wirelessly receive command signals from the plurality of remote control devices and to wirelessly transmit the parameter values of the audio signal sources and of the sound reproduction sources to the remote control devices. The remote control devices are constructed and arranged for wirelessly transmitting the command signals to the system controller and for wirelessly receiving the parameter values and displaying the parameter values, and are further constructed and arranged to transmit the command signals to and receive the parameter values from a system controller that is separated from the remote control.

In another aspect of the invention, an audio device includes an enclosure having a volume of less than 60 cubic inches; input terminals accommodating input signal lines from a plurality of audio signal sources; output terminals accommodating output signal lines to a plurality of sound reproduction devices; a radio tuner, enclosed by the enclosure; circuitry, enclosed by the enclosure, for selectively intercoupling the input terminals and the output terminals; and a system controller enclosed by the enclosure, for wirelessly receiving control signals from a remote control device and for transmitting the control signals to the input terminals, the output terminals, and the radio tuner.

In another aspect of the invention, an audio device includes a radio tuner; input terminals constructed and arranged for accommodating input signal lines from a plurality of audio signal sources; output terminals constructed and arranged for accommodating output signal lines to a plurality of sound reproduction devices; a configurable signal router constructed and arranged for routing signals from the input terminals to the output terminals; and a system controller constructed and arranged for two-way communicating with a remote control device. The audio device is free of manual controls for the tuner and for devices coupled to the input terminals and the output terminals.

In another aspect of the invention, an audio system includes a system. controller, adapted to receive control signals from a remote control device and to transmit the control signals to a plurality of remote locations. The system controller includes output terminals adapted to accommodate intercoupling circuitry intercoupling the system controller and a sound reproduction device; and sensors for providing connection signals representative of which output terminals are connected to intercoupling circuitry. The remote control device includes illuminatable graphic figures corresponding to each of the terminals and illuminating circuitry responsive to the connection signals for illuminating only those graphic figures corresponding to output terminals to which intercoupling circuitry is connected.

In another aspect of the invention, an audio system includes a system controller, adapted to receive control signals from a remote control device and to transmit the control signals to a plurality of remote locations; a sound reproduction device; and sensors to sense if the sound reproduction device includes surround speakers. The remote control device includes illuminatable graphic figures corresponding to the sound reproduction device, the illuminatable graphic figures including graphic figures facilitating control of the surround speakers. The remote control device also includes illuminating circuitry for illuminating the graphic figures facilitating control of said surround speakers, the illuminating circuitry not illuminating the graphic figures facilitating control of the surround speakers if the sound reproduction device does not include surround speakers.

In another aspect of the invention, an audio system includes a plurality of audio signal sources, a plurality of sound reproduction devices, and volume setting circuitry for independently setting the volume of the plurality of the sound reproduction devices so that the selected plurality of sound reproduction devices may selectively have a volume offset. The audio system also includes a system controller, for selectively coupling the audio signal sources and the plurality of sound reproduction devices in a plurality of alternative configurations, the alternative configurations including a first configuration in which a selected plurality of the sound reproduction devices receives audio signals from a selected one of the audio signal sources and a second configuration in which the each of the selected plurality of the sound reproduction devices receives audio signals from another of the audio signal sources. The audio system further includes volume adjusting circuitry for adjusting the volume of the selected plurality of sound reproduction devices such that the if the selected plurality of sound sources is configured in the first configuration the offset is maintained and such that if the selected plurality of sound sources is configured in the second configuration, the offset is not maintained.

In another aspect of the invention, an audio system includes a plurality of audio signal sources, a plurality of sound reproduction devices, each having an on state and an off state, a system controller, for selectively coupling the audio signal sources and the plurality of sound reproduction devices such that a selected plurality of the sound reproduction devices can receive audio signals from a selected one of the audio signal sources, and a remote control device, for facilitating a user selecting the selected plurality of sound reproduction devices and the selected one of the audio signal sources and for transmitting user selections to the system controller. The remote control device includes a control for switching the sound reproduction devices from the off state to the on state, constructed and arranged so that the sound reproduction sources that receive audio signals from the same audio signal source are switched from the off state to the on state simultaneously.

In still another aspect of the invention, a remote control device includes a touch screen comprising a plurality of illuminatable graphic figures, command transmitting circuitry for responding to a touching of the graphic figures by transmitting a corresponding command, and disabling circuitry for responding to a touching of a predetermined one of the graphic figures by disabling the command transmitting circuitry for a period of time.

Other features, objects, and advantages will become apparent from the following detailed description, when read in connection with the accompanying drawings in which.

Figure 3A:
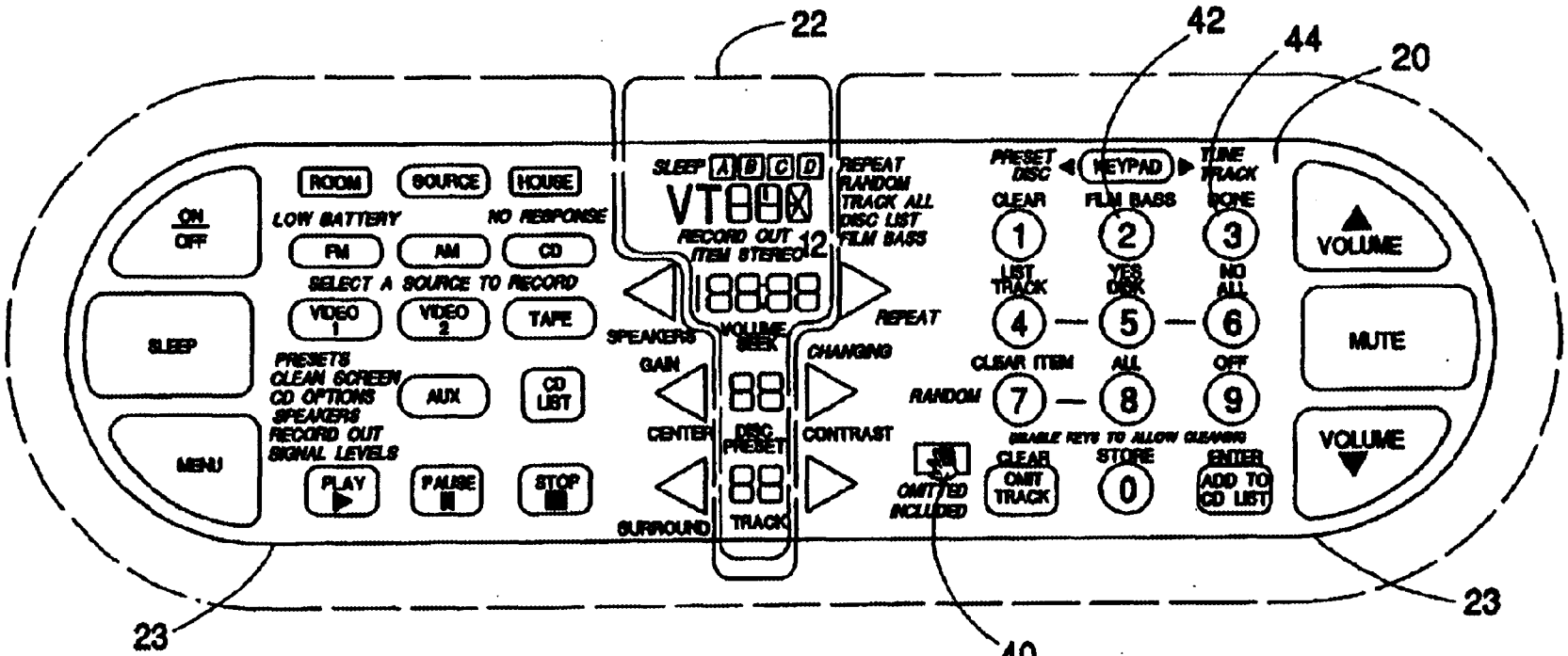
Figure 3B:
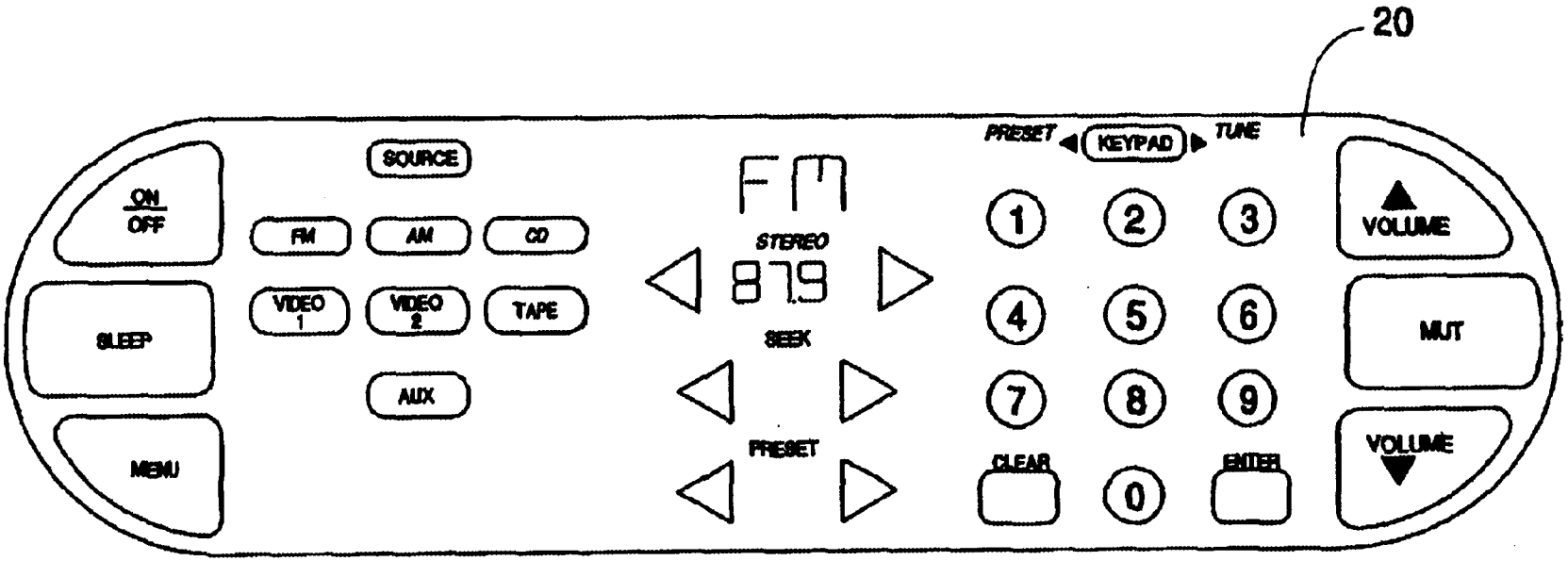
Figure 3C:
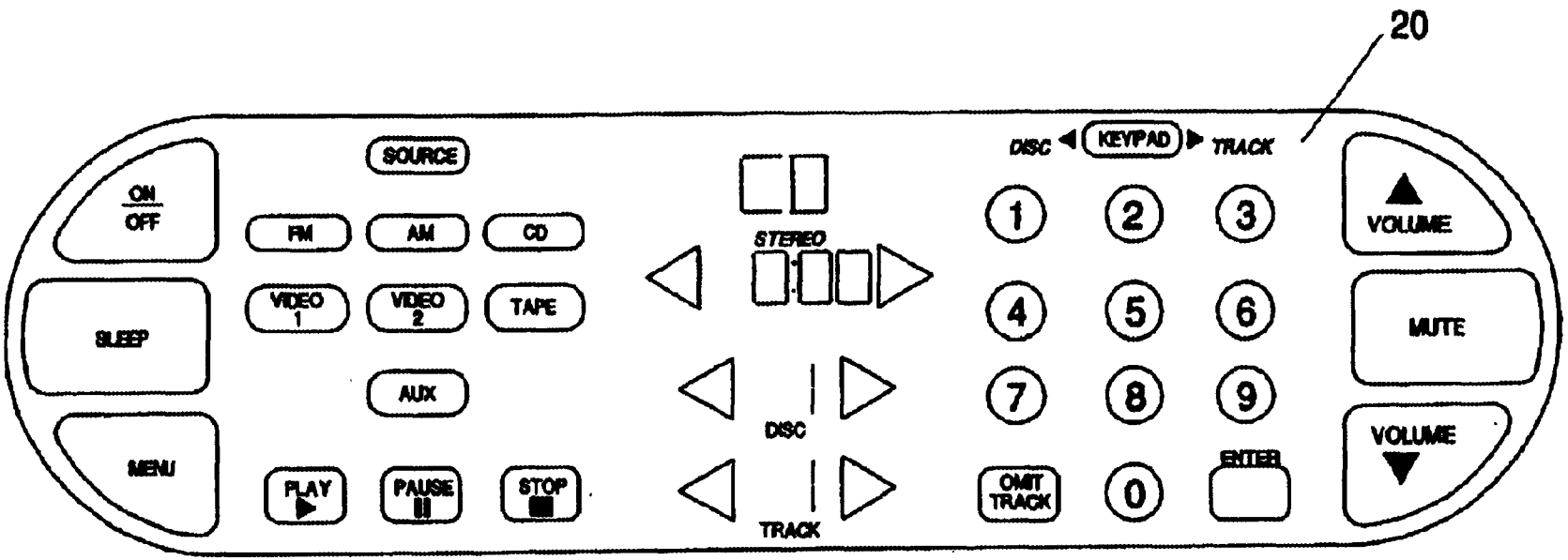
Figure 4:
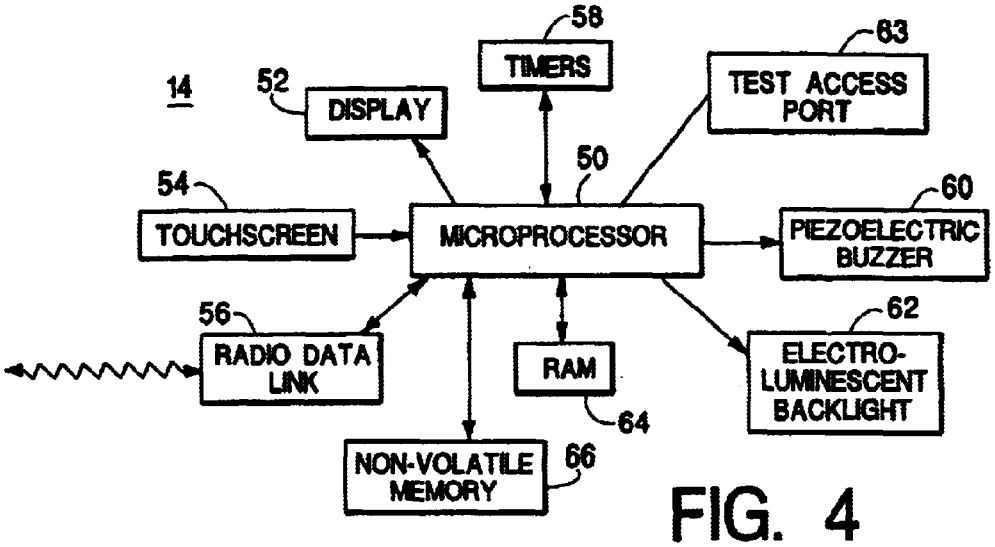
Figure 6:
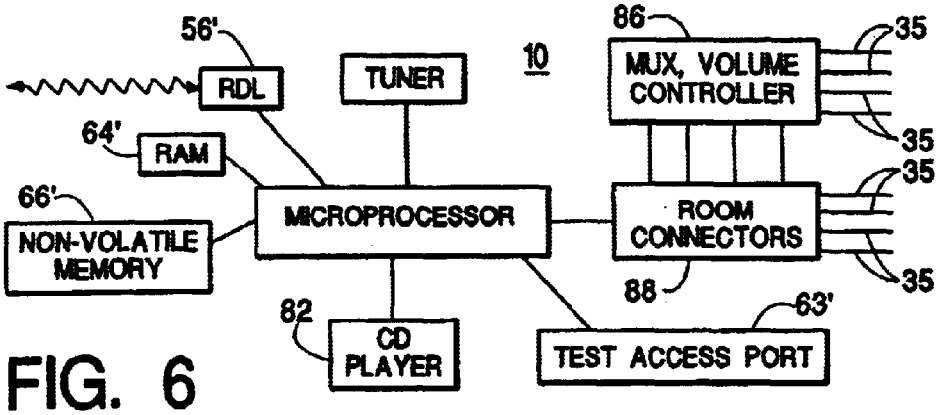
Figure 8:
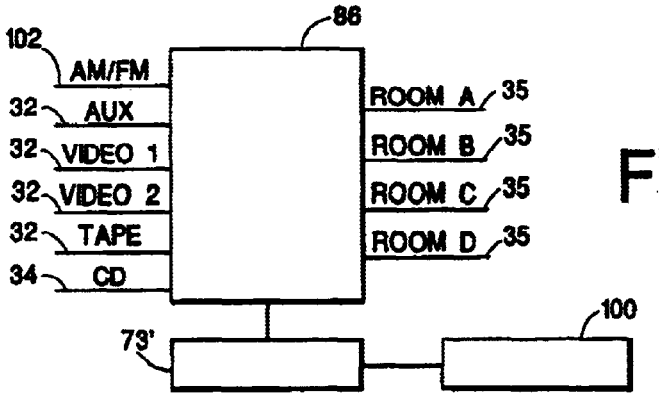
Figure 5:
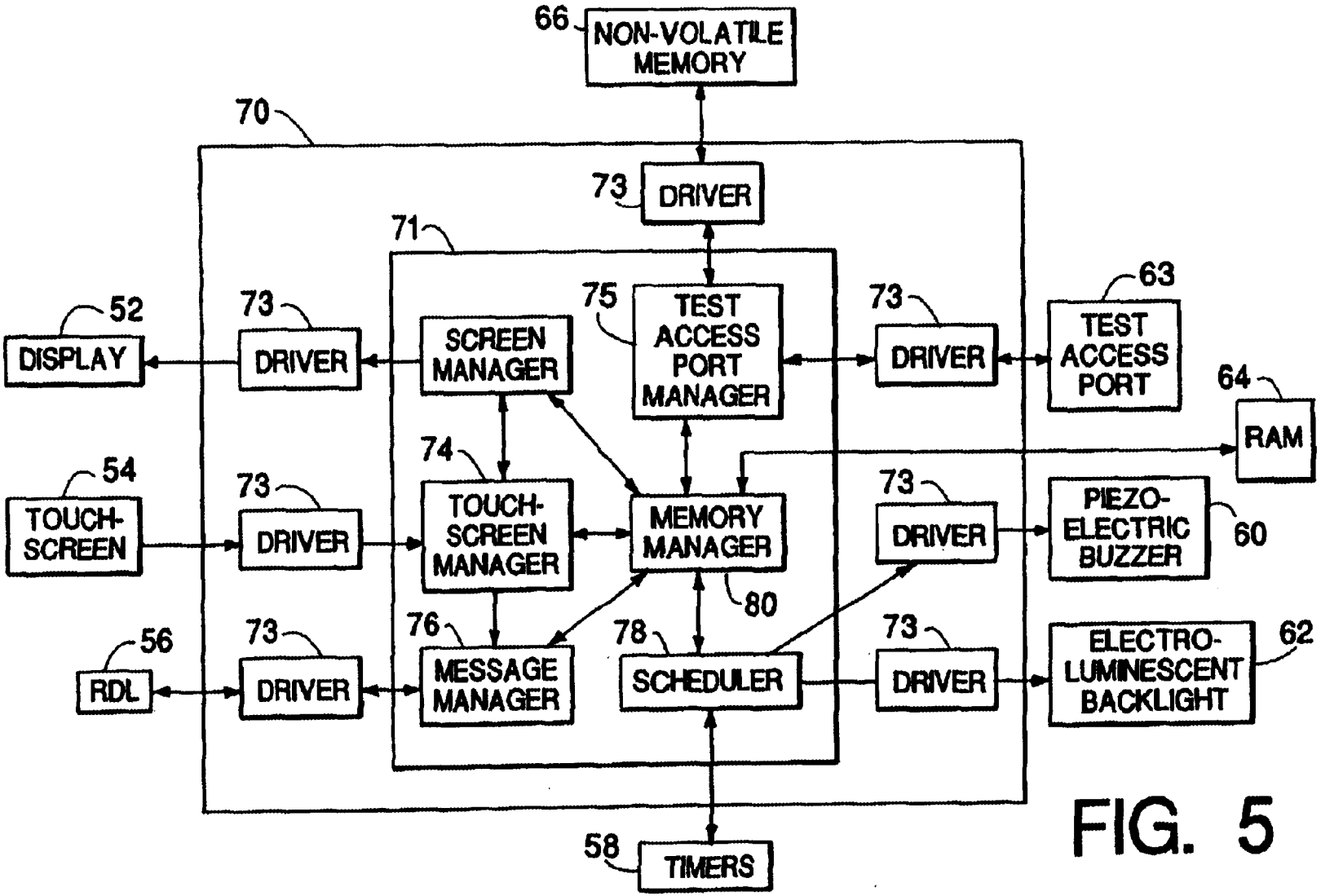
Figure 7:
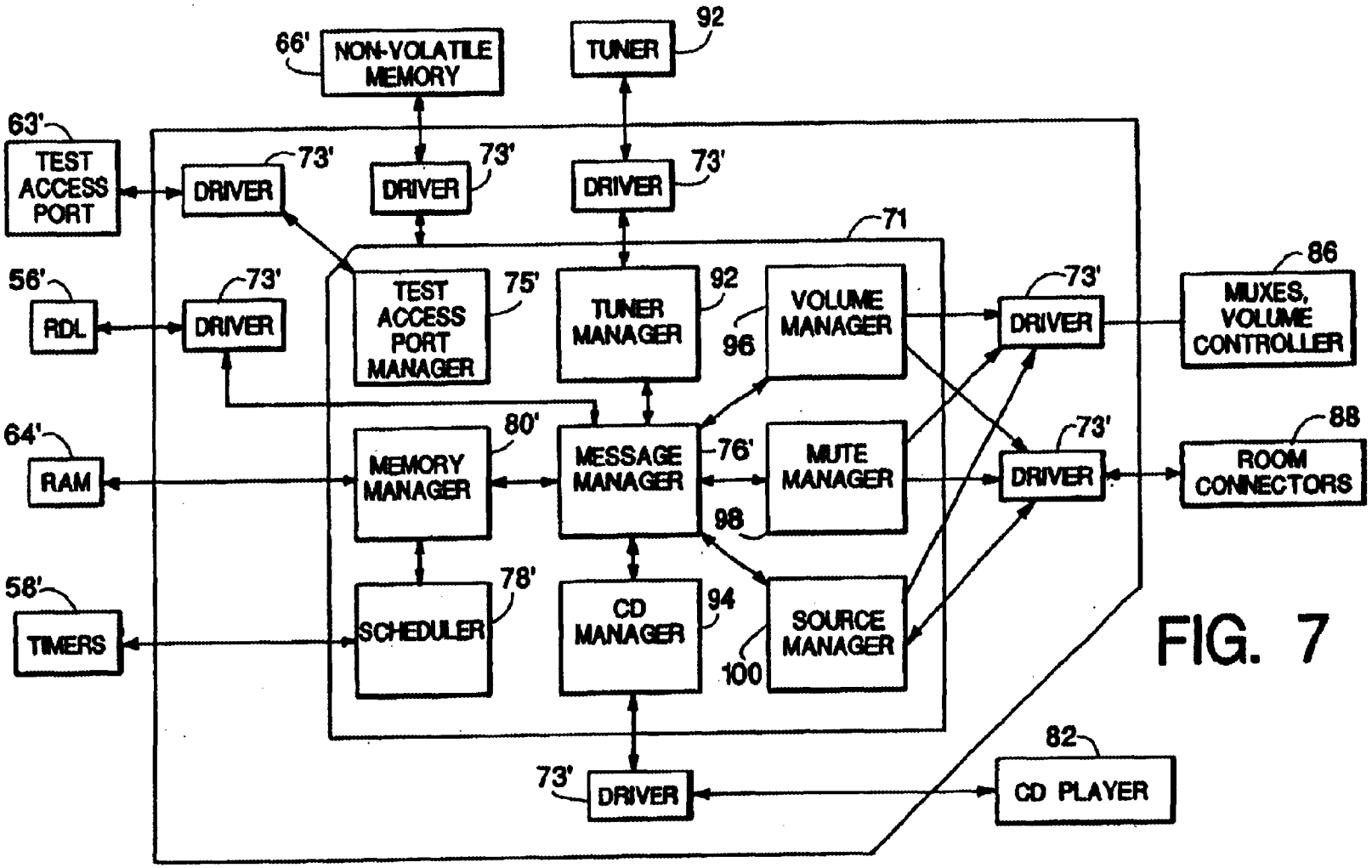

FIGS. 3*a*–3*c* are views of a remote control device according to the invention;

FIG. 4 is a block diagram of a remote controller according to the invention;

FIG. 5 is a diagram of the flow of control signals and information in the remote controller of FIG. 4;

FIG. 6 is a block diagram of a system controller according to the invention;

FIG. 7 is a diagram of the flow of control signals and information in the microprocessor of FIG. 6; and FIG. 8 is a block diagram of the flow of audio signals in an audio system according to the invention.

Figure 1:
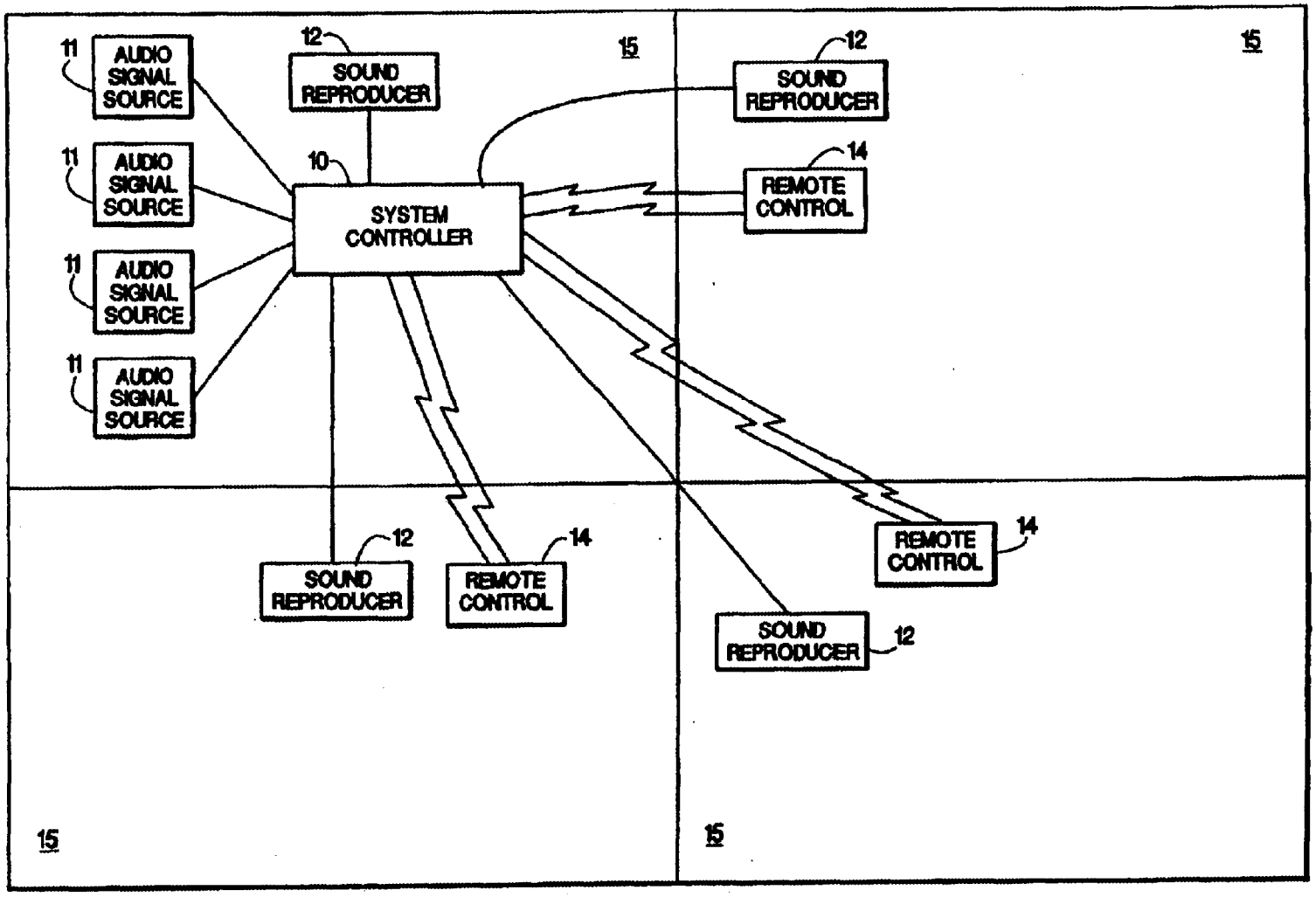
FIG. 1 is a block diagram of an audio system according to the invention.

With reference now to the drawings and more particularly to FIG. 1, there is shown an audio system for use with a remote control device according the invention. A multizone sound system includes a system controller 10 which is adapted to receive user input signals from, and send information signals to, a plurality of remote control units 14. System controller 10 is in turn adapted to transmit control signals and audio signals to a plurality of sound reproduction devices 12, which may be located in different rooms 15 in a house, and to transmit audio signals and control signals to, and receive audio signals from, audio signal sources 11.

Sound reproduction devices 12 may include devices such as amplifiers and powered loudspeaker systems. Audio signal sources 11 may include devices such as CD players, DVD players, tuners, tape decks, or record players and/or the like. Coupling of the system controller 10 and sound reproduction devices, and between system controller 10 and audio signal sources may be by some wireless means, but are typically coupled through electrical cabling. System controller 10 may have terminals for accommodating connectors for cables adapted to transmit signals to and from sound reproduction devices, and may also have sensors to detect which of the terminals have connectors attached to the terminals. The plurality of terminals for coupling to sound reproduction devices enables the audio system to have several sound reproduction devices, which my be placed in different rooms 15 about a house. For ease of explanation, it is convenient to refer to each of the terminals as a "Room"; thus "Room 1" and "Room 2" refer to different terminals on the system controller, and "in Room 1" means connected to the terminal denoted as "Room 1", and in Room n, where n is an integer, means connected to terminal "Room n" regardless of where the attached sound reproduction device is physically placed.

System controller 10 receives user input signals from, and transmits system status information to, remote control units 14. The elements of the audio system may be physically arranged in a variety of ways. In one arrangement, system controller 10 and an AM/FM tuner are included in one unit.

System controller 10 is adapted to receive user input instructions from any one of a plurality of remote control units 14 and to transmit system status information to remote control units 14. System controller 10 is adapted to transmit and receive signals to and from remote control units 14 by wireless methods. In one embodiment, system controller 10 and remote control units 14 are adapted to communicate on radio frequencies, thereby allowing communications with remote control units which are in a different room from system controller 10 without the need for a second system controller, and additionally enabling remote control units to be moved from room to room. The sound system typically includes a single system controller 10 and may include several remote control units 14, thereby allowing each sound reproduction device and each sound reproduction device to be controlled from several remote control units.

System controller 10 is adapted to configure the system, that is, to selectively couple audio signal sources and sound reproduction devices according to user instructions. Sound reproduction devices may receive audio signals from any of the audio signal sources, and the signal from each audio signal source may be routed to more than one sound reproduction device. So, for example, a sound reproduction device in room 1 can "select," that is, receive audio signal sources from, any audio signal source attached to system controller 10. Sound reproduction devices in different rooms may "share" the same source, that is, select the same source. A source being shared by multiple rooms may be "synchronized" in some aspects, so, for example, changing the volume in one room also changes the volume in another room. The volume may be designated using an arbitrary scale. So, for example, a volume setting of zero may be used to designate a threshold of audibility, and a volume setting of 100 may be used to designate the maximum volume setting.

Figure 2:
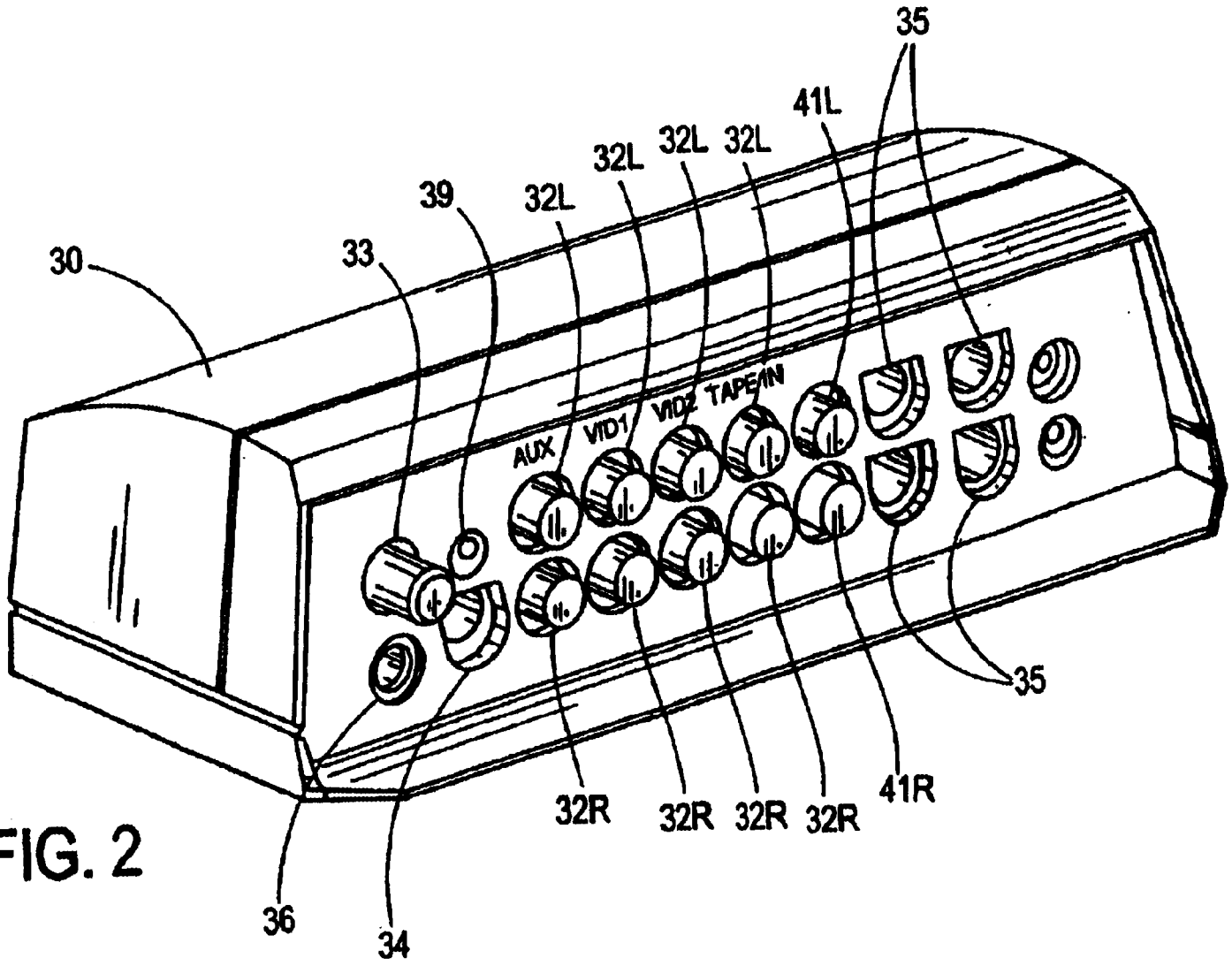
FIG. 2 is a view of an enclosure for certain elements of the audio system of FIG. 1.

Referring to FIG. 2, there is shown an embodiment of an enclosure 30 for enclosing system controller 10 and an AM/FM tuner. Enclosure 30 has terminals for accommodating connections to audio signal sources, such as tape players, the audio portion of audio/video sources such as cable television, broadcast television, satellite television, DVD players, VCRs, and/or the like. Terminals are arranged in pairs, with one input 32R for a right channel input, and a second input 32L for a left channel input. Each pair of terminals is adapted to receive a two channel signal from an audio signal source 11 of FIG. 1. In this embodiment, there are four pairs of input terminals, designated "Aux", "Vid 1", "Vid 2", and "Tape In". Enclosure 30 may also include a terminal 34 for a CD player, with the terminal arranged to accommodate a cable that transmits the audio signal from the CD player to the system controller, power from the system control unit to the CD player, and control and information signals between system controller 10 and the CD player. The enclosure is small, having a volume of about 55 cubic inches, typically about 7.4" wide by 3.5" deep by 2.125" high, and has no external controls or displays; the enclosure may have on it a mechanical pushbutton 36, which may send a signal to remote control devices 14 which causes them to emit an audible signal, allowing a user to locate a remote control device. Enclosure 30 also has terminals 35 which accommodate connectors to sound reproduction devices 12. As mentioned in the discussion of FIG. 1, terminals 35 may include sensors which determine whether a connector is engaged in each of terminals 35. Additional terminals may include an input 33 for an FM signal; an input 39 for an AM signal; a pair of outputs 41L, 41R, for outputting to an external recording device, such as a tape recorder; and a data/test port 43. The small size, the lack components that need to be seen (such as displays) or physically accessed (such as displays or CD players), and the use of a nonoptical transmission mode, such as RF, between the remote control units 14 and the system controller 10, facilitate placing enclosure 30 in any convenient location, even one that is concealed from the listener, even in a different room. Additionally, enclosure 30 can be placed in any orientation.

Referring now to FIG. 3*a*, there is shown an example of a user interface screen 20 of a remote control unit 14. User interface screen 20 includes an indicator area 22 that is used to indicate current parameter values of a user selected device. The remainder of the screen may be employed by the user to transmit commands to system controller 10. Indicator area 22 typically consists of LCD segments that may be selectively energized so that they are visible (hereinafter "illuminated") so that the set of segments can be used to form a variety of different alphanumeric characters, depending on the device the user is controlling. So, for example, the LCD segments used to form "FM" in FIG. 3*b* (the user interface screen when the user is controlling the FM tuner) are used to form "CD". in FIG. 3*c* (the user interface screen when the user is controlling a CD player). The command input area 23 of the screen may also contain similar LCD segments, or mechanical pushbuttons, or, as in FIG. 3*a*, LCD characters that are fixed graphic figures that can be energized so that the fixed graphic figures are visible (hereinafter "illuminated"). If the command input portion of the screen contains fixed graphic figures, there may be circuitry that allows selective illumination of the graphic figures and which causes the command input area to act as a "touch-screen" device, that is, to react to pressure on a portion of the screen as if a mechanical pushbutton had been pushed. In this disclosure "push" and "keys" or "buttons" are use to indicate applying pressure to a selected portion of the screen. To increase contrast between the LCD segments and blank portions of the screen, the screen may be backlit.

Parameter values displayed in indicator area 22 are dependent on the device that is selected. For example, if the selected device is a tuner, the parameters displayed may be the band and the tuning frequency. If the selected device is a CD player, the parameters displayed may be the disc number and the track. Parameters not relevant to a device are not displayed.

The audio device being controlled can be selected by the user by pressing a graphic figure in the command input area of screen. So, for example, the user can issue commands to a audio signal source by pressing the appropriate "source" graphic figure in the on the screen (for example, in FIG. 3*a*, the "FM", "AM", "CD", "Video 1", "Video 2", and "TAPE" graphic figures). Once a source has been selected, only graphic figures representing commands that pertain to that source are illuminated, and information concerning that source is displayed in the indicator area 22. The user can issue commands to a room or combination of rooms by selecting the room or combination of rooms by pressing the "Room" graphic figure, which toggles through all rooms (the A, B, C, D, graphic figures in indicator area 22) and combination of rooms which have sound reproduction devices 22 connected to them. Once the sound reproduction device (or combination of rooms) has been selected, only graphic figures representing commands appropriate to the sound reproduction device or devices in that room or combination of rooms are displayed, and information concerning the sound reproduction device is displayed in indicator area 22.

If two or more rooms are sharing a device, the user can select each room individually, or both rooms collectively. This allows some adjustments to be made to each sound reproduction device individually, or both sound reproduction devices collectively. For example, the volume can be set individually, or adjusted collectively. If the volume is changed collectively, all rooms are adjusted accordingly from their starting position, and any offset between the rooms is remembered. If the volume of the displayed room is adjusted such that one of the non-displayed rooms reaches a maximum or minimum, the offset is remembered, and when the volume of the displayed room is adjusted such that the non-displayed room is back in range, then the volume in the non-displayed room will resume changing, and the offset between the rooms is maintained. For example if room A is the displayed room and the volume of the sound reproduction device in room A is 50, and room B is not displayed and the volume of the sound reproduction device in room B is 80, there is a 30 offset between the rooms. If the volume of the sound reproduction device in room A is adjusted upward, the volume of B is adjusted upward also, maintaining the 30 offset. If the volume of B reaches 100 (the maximum volume), the volume will not be adjusted upward any more. If the volume of the sound reproduction device in room A is adjusted downward, the volume of the sound reproduction device in room B will remain at 100 until the volume of the sound reproduction device in room A is at 70, and any continued reduction in the volume of the sound reproduction device in room A will also reduce the volume of the sound reproduction device in room B so that the 30 offset between the rooms is maintained.

In addition to only displaying graphic figures representing commands appropriate to a sound reproduction device or signal source, the remote control device may display only graphical figures that represent commands that are appropriate to certain configurations of audio devices. If there is no device attached to a terminal, then the graphical figures pertaining to the room representing that terminal may not be displayed. The audio system may include logic to determined if surround speakers in a multi-channels sound reproduction device are connected, and if the surround speakers are not connected, the graphical figures pertaining to surround speaker adjustment may not be displayed.

When the "Clean Screen" graphic FIG. 40 of FIG. 3*a* is pressed, "clean screen" mode is activated. In clean screen mode, all keys are disabled, so that no commands can be entered for a predetermined period of time, such as 20 seconds. Clean screen mode enables a user to clean the screen without requiring an off-screen button to disable the keys, an off-screen button to turn the remote control unit off, or some other means to disable or turn off the remote control button, such as removing batteries. Additional features of clean screen mode may include indicating the time remaining in the predetermined period of time in the indicator area 22, and emphasizing time remaining when the time remaining is very short, for example causing the timer remaining to blink when the time remaining reaches five seconds; not illuminating any graphic figures except the "clean screen" graphic figure; illuminating a message that indicates that the keys are disabled to allow cleaning; and preventing accidental launches of clean screen mode by requiring the user to affirm intention to enter clean screen mode by touching a "yes" 42 or "no" 44 graphical figure.

Referring to FIG. 4, there is shown a block diagram of remote control unit 14. Microprocessor 50 is coupled to display 52, touchscreen 54, radio data link (RDL) 56, piezoelectric buzzer 60, electro-luminescent backlight 62, test access port (TAP) 63, RAM 64, and non-volatile memory 66. RDL 56 transmits signals to, receives signals from, system controller 10 (not shown in this view).

Display 52, responsive to instructions from microprocessor 50, selectively illuminates graphical figures on display screen as shown in FIGS. 3*a*–3*c* and described in the corresponding section of the disclosure. Touchscreen 54 responds to pressure from a user touch by transmitting to microprocessor 50 the location that was touched, and microprocessor interprets the location by issuing a command. If the command affects a system component other than remote control device 14, it is transmitted to system controller 10 of FIG. 1 through RDL 56. Microprocessor 50 also controls piezoelectric buzzer 60, to provide auditory feedback to a listener, and electro-luminescent backlight 62.

Referring to FIG. 5, there is shown the logical arrangement of the control and information flow of microprocessor 50. Control and information flow are controlled. by software system 70, which includes a plurality of device drivers 73 and operating system 71. Device drivers perform one or both of two functions. They receive information from a module of the operating system and transform the information into a form usable by an associated device; and they receive information from the device and transform the information into a form usable by the operating system. Drivers are typically implemented in software. Operating system 71 includes screen manager module 72, touchscreen manager module 74, test access port manager 75, message manager module 76, scheduler module 78, all of which may be implemented in software. Modules 72, 74, 76, and 78 read and write to RAM 64 through memory manager 80. Scheduler module 78 also accesses timing information from timers 62. Touchscreen manager module 74 exchanges information with screen manager 72 and message manager 76.

Operating system 71 stores in RAM 64 a number of state variables. State variables may include whether a device is coupled to each of the terminals 32 (of FIG. 2) of the system controller 10 (of FIG. 1); if a device is coupled to one of the terminals 32, whether the device includes surround speakers; which sound reproduction devices 12 receive audio signals from which audio signal sources 11 (of FIG. 1); the volumes of the sound reproduction sources; whether the sound reproduction sources are on or off; whether the touchscreen is enabled or disabled, and other information that may be desired. State variables may be changed when a command is issued by a user touching touchscreen 54, or when the remote control device receives update information from system controller 10 (of FIG. 1) through RDL 56. Non-volatile memory may be used to store information necessary to start up of the operating system if the remote control device loses power, or information that may be desirable to preserve if the device loses power, such as extensive CD play lists.

Referring to FIG. 6, there is shown a block diagram of system controller 10. Microprocessor 50' is coupled to radio data link (RDL) 56', RAM 64', non-volatile memory 66', test access port 63', CD player 82, tuner 84, volume controller and multiplexers 86, and room connectors 88. Volume controller and multiplexers 86 and room connectors 88 each have a plurality, in this case four, of outputs corresponding to the terminals 35 of FIG. 2.

Based on user inputs received from remote control unit 14 at RDL 56', microprocessor 50' issues commands to CD player 82, tuner 84, and to attached sound reproduction devices 12 of FIG. 1 through terminals 35 of and volume controller and multiplexers 86, and room connectors 88.

Terminals 35 are adapted to transmit signals from both room connectors 88 and volume controller and multiplexer 86 because the terminals are adapted to accommodate multi-pin connectors, so there are multiple signal paths between system controller 10 and sound reproduction devices 12.

Referring to FIG. 7, there is shown the logical arrangement of the control and information flow of microprocessor 50'. Control and information flow are controlled by software system 70', which includes a plurality of device drivers 73' and operating system 71'. Device drivers perform one or both of two functions. They receive information from a module of the operating system and transform the information into a form usable by an associated device; and they receive information from the associated device and transform the information into a form usable by the operating system. Drivers are typically implemented in software. Driver for volume controller and multiplexer 86 may use the "IIC" protocol, which is a popular protocol for controlling devices of this type. Operating system 71 includes tuner manager module 92, CD manager module 94, volume manager 96, mute manager module 98, source manager module 100, message manager module 76', scheduler module 78', all of which may be implemented in software.

In operation, message manager module 76' receives a command from remote control unit 14 through RDL 56'. Message manager module 76' routes the message to the appropriate other modules (92, 94, 96, 98, 100) to execute the command. If the execution of the command results in the change of a state variable, then the message manager changes, through memory manager 80', the value of the state variable that is stored in RAM 64'. Examples of state variables are discussed above, in the discussion of FIG. 5. In order to ensure that values of state variables store in RAM 64' are identical to values of state variables stored in RAM 64 of remote control unit 14, message manager 76' may transmit a message through RDL 56' to remote control units whenever the value of a state variable changed, and may also periodically transmit the values of state variables in the event that a previous transmission was not received by one of the remote control devices 14.

Referring now to FIG. 8, there is shown a block diagram illustrating the flow of audio signals. Multiplexer and volume control 86 has inputs from audio signal sources (represented in this view as a single input 32 corresponding to paired terminals 32L and 32R of FIG. 2), an audio signal input 34 from a CD player, and an input 102 from the tuner 12 of FIG. 1. Multiplexer and volume control 86 has outputs corresponding to terminals 35 of FIG. 2. Based on control signals resulting from operation of source manager module 100 of operating system 71', transmitted through driver 73', multiplexer and volume control 86 selectively routs audio signals received at inputs 32, 34, and 102 to terminals 35. Output terminals 35 may be adapted to accommodate multiple signal lines so that control and information signals (as discussed above in the discussion of FIG. 7) and audio signals may all be transmitted through the same terminal. Driver 73' for the room connectors 88 contains logic that detects in so-called "smart" speakers the presence of surround speakers. Examples of "smart" speakers are the Acoustimass® loudspeakers commercially available from the Bose Corporation of Framingham, Mass.

Other embodiments are within the claims.

What is claimed is:

1. A remote control device, comprising:

a touch screen comprising a plurality of illuminatable graphic figures, command transmitting circuitry for responding to a touching of said graphic figures by transmitting a corresponding command, disabling circuitry, for responding to a touching of a predetermined one of said graphic figures by disabling said command transmitting circuitry for a period of time.

2. A remote control device, comprising:

a touch screen comprising a plurality of illuminatable graphic figures, command transmitting circuitry for responding to a touching of said graphic figures by transmitting a corresponding command, disabling circuitry, for responding to a touching of a predetermined one of said graphic figures by disabling said command transmitting circuitry for a period of time and, further comprising blanking circuitry for responding to said touching of said predetermined one of said graphic figures by blanking a portion of said touch screen for said period of time.

3. A remote control device, comprising:

a touch screen comprising a plurality of illuminatable graphic figures, command transmitting circuitry for responding to a touching of said graphic figures by transmitting a corresponding command, disabling circuitry, for responding to a touching of a predetermined one of said graphic figures by disabling said command transmitting circuitry for a period of time, and further comprising display circuitry for displaying the remaining portion of said period of time.

* * * * *